US006496168B1

(12) United States Patent
Tomida

(10) Patent No.: US 6,496,168 B1
(45) Date of Patent: Dec. 17, 2002

(54) DISPLAY ELEMENT DRIVE DEVICE

(75) Inventor: Takayuki Tomida, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 109 days.

(21) Appl. No.: 09/676,934

(22) Filed: Oct. 2, 2000

(30) Foreign Application Priority Data

Oct. 4, 1999 (JP) ..... 11-282779

(51) Int. Cl.[7] ..... G09G 3/30

(52) U.S. Cl. ..... 345/76; 345/77; 345/34; 345/35; 345/36; 345/45; 315/169.3; 327/108; 340/825.1

(58) Field of Search ..... 345/76, 77, 34, 345/35, 36, 44, 45; 327/108; 315/168, 169.1, 169.3; 348/800; 340/825.1

(56) References Cited

U.S. PATENT DOCUMENTS 4,225,807 A * 9/1980 Ise et al. ..... 315/169.3
4,443,741 A * 4/1984 Tanaka et al. ..... 315/158
6,011,416 A * 1/2000 Mizuno et al. ..... 327/108
6,061,041 A * 5/2000 Yoshida ..... 345/76
6,291,942 B1 * 9/2001 Odagiri et al. ..... 315/169.3

FOREIGN PATENT DOCUMENTS

JP 10-301188 11/1998

* cited by examiner

*Primary Examiner*—Bipin Shalwala
*Assistant Examiner*—Jimmy H. Nguyen
(74) *Attorney, Agent, or Firm*—Oliff & Berridge, PLC

(57) ABSTRACT

A transistor Q11 for supplying driving currents Ia to In to EL display elements 11*a* to 11*n* is provided in a stabilization voltage supply circuit 33. The transistor Q11 is connected to a current sensing resistor Ras for detecting a collector current of the transistor Q11. When a total current Ix for driving the EL display elements rises to a certain abnormal level, a bias suppressing element Qa is turned on to thereby reduce a base-emitter bias of the transistor 11.

2 Claims, 8 Drawing Sheets

DISPLAY ELEMENT DRIVE DEVICE

BACKGROUND OF THE INVENTION

This invention relates to a display element drive device for driving a single EL display element or a plurality of parallel-connected EL display elements.

FIG. 5 shows the relation between the current density and brightness of an organic EL light emitting element. The coordinates of the current density and brightness are logarithmically represented. Generally, the organic EL light emitting element is a current-driven light emitting element. As shown in FIG. 5, the luminance brightness of the organic EL light emitting element is determined according to the current value per unit area, that is, the current density of the light emitting element. It is, therefore, important for uniforming the brightness and improving display quality to set the current density with good accuracy.

FIG. 6 is a circuit block diagram illustrating an example of an organic EL light emitting element of the dot matrix type. As illustrated in FIG. 6, in the case of using the EL light emitting elements each having a constant area like those of the dot matrix type, while display rows are selected by sink type row drivers 4, all pixels can be driven by a single constant current reference source 1 and a plurality of constant current drivers (that is, source type column drivers) 2*a*, 2*b*, 2*c*, . . . , 2*n*. Incidentally, in FIG. 6, reference numeral 3 designates each of the organic EL light emitting elements.

Incidentally, in addition to the dot matrix display apparatus, a fixed segment display apparatus has been generally known. Despite the constraint that a display pattern is fixed, this fixed segment display apparatus has advantages in that the display apparatus of this type can display edge portions of curves more beautifully than the display apparatus of the dot matrix type, and that the EL light emitting elements are easily manufactured because of a small number of steps of a manufacturing process thereof. Thus, the fixed segment display apparatus is effectively used in relatively low cost equipment and in field requiring display quality.

Unlike the dot matrix display apparatus, the areas of individual pictures (or segments) differ from one another in the fixed segment display apparatus. Thus, the current values of the driving currents of individual segments differ from one another. Therefore, a plurality of constant current reference sources are needed for causing the segments to emit light with the same brightness.

FIG. 7 is a circuit block diagram illustrating a conventional fixed segment display apparatus. In this apparatus, a plurality of constant current reference sources 5*a*, 5*b*, 5*c*, . . . , 5*n* supply constant currents to constant current drivers 6*a*, 6*b*, 6*c*, . . . , 6*n*, respectively. Thus, each of organic EL light emitting segments 7*a*, 7*b*, 7*c*, . . . , 7*n* is driven.

Thus, in the fixed segment display apparatus, the display pattern varies with the segments. Further, the number of the segments and the areas of the segments vary with apparatuses to which the display pattern is applied. Therefore, it is not preferable from the viewpoint of standardization of the display apparatus to fix a set value of each of the preliminarily prepared constant current sources 5*a*, 5*b*, 5*c*, . . . , 5*n* for a drive device consisting of the constant current reference sources 5*a*, 5*b*, 5*c*, . . . , 5*n* and the current drivers 6*a*, 6*b*, 6*c*, . . . , 6*n*. Consequently, this conventional display apparatuses have a drawback in that a drive device should be custom-designed for each of the display apparatuses. Moreover, the use of the plurality of constant current reference sources 5*a*, 5*b*, 5*c*, . . . , 5*n* itself hinders the enhancement of the area efficiency of the circuit.

Incidentally, it is possible to use a constant voltage circuit instead of the drive circuit shown in FIG. 7 and parallel-connect all the organic EL light emitting elements with the constant voltage circuit. In this case, the custom-designed constant current reference sources are unnecessary. Consequently, the area efficiency of the circuit can be enhanced.

However, generally, according to the voltage-current characteristic of the organic EL light emitting element, change in the current increases exponentially with increase in the voltage, as illustrated in FIG. 8. Thus, in the case of the drive circuit using the constant voltage circuit, even when a small error occurs in the constant voltage, the current density may largely change. Consequently, there is a fear that the brightness of the organic EL light emitting element largely changes, and the display quality is deteriorated. It is, therefore, necessary to precisely adjust the voltage supply. Consequently, the provision of a more complex voltage stabilization circuit is needed. Especially, in the case that organic EL light emitting elements in an automobile instrument panel are driven by being supplied with power from an automobile battery, there is the necessity for applying voltages to drive loads other than a power steering device and a power window device. Thus, there has been a problem of how to achieve the stabilization of a supply voltage.

Additionally, the resistance value of the organic EL light emitting element may change owing to the deterioration thereof and to the influence of the ambient temperature, so that the driving current changes. Consequently, there has been a problem of how to stabilize the brightness of the organic EL light emitting element.

SUMMARY OF THE INVENTION

In view of the problems of the conventional example, in the Japanese Patent Application No. 10-301188, the Applicants of the present application have proposed a display element drive device (namely, a proposed device example), which serves as a display element drive circuit enabled to increase the area efficiency of the circuit, and to be adapted to standardization, and to cause small change in the luminance brightness of display elements when the display elements are supplied with power from an automobile battery that is relatively liable to bring about voltage variation, and to stably maintain the luminance brightness even when the resistance value of the display element changes owing to the deterioration thereof, and to have excellent durability.

In this proposed device example, as illustrated in FIGS. 9 and 10, a plurality of fixed segment organic EL display elements 11*a* to 11*n* are parallel-connected to one another, and a stabilization voltage is supplied to the parallel circuit. Thus, the plurality of conventional drive reference sources (namely, the current sources) needed owing to the difference in the area among the segments are omitted. Moreover, the segments are allowed to have the same brightness.

Further, to deal with variation in characteristics and aged deterioration in the voltage-driven case, the device has a current detecting means 31 (a drive state detecting means) for detecting the current value of electric current supplied to one specific organic EL display element (hereunder referred to as "reference organic EL display elements") 11*z* (reference light emitting element) other than the organic EL display elements 11*a* to 11*n*, and for outputting a current value signal adapted to change according to the electric current value, a voltage control circuit 32 for converting a current value signal, which is received from the current detecting means 31, into a stabilization voltage adjustment signal, and a stabilization voltage supply circuit 33 for converting a voltage Vin, which is supplied from an astable battery power supply (+B), into a constant stabilization voltage Vout.

Incidentally, the reference organic EL display element 11*z* is connected to the current detecting means 31, and supplied with electric current from the current detecting means 31. On the other hand, other organic EL display elements 11*a*, . . . , 11*n* are supplied with electric current through predetermined switching circuits 15 (15*a* to 15*n*), as illustrated in FIG. 10.

Each of the switching circuits 15 (15*a* to 15*n*) has a PNP transistor Q6 for supplying driving currents Ia to In to the organic EL display elements 11*a* to 11*n*, and an NPN transistor Q5 for switching on and off the transistor PNP. The base of the PNP transistor Q6 is connected to the collector of the NPN transistor Q5 through a resistor R5. Moreover, the base of the NPN transistor Q5 is connected to the control portion 13 through a resistor R4. Furthermore, the emitter of the NPN transistor Q5 is grounded. These switching circuits 15 (15*a* to 15*n*) are parallel-connected to one another. Further, a common stabilization voltage Vout is applied to the switching circuits 15 (15*a* to 15*n*). Incidentally, as illustrated in FIG. 9, each of the switching circuits 15 (15*a* to 15*n*) is switched on and off according to a switching signal outputted from the control portion 13.

The current detecting means 31 is used for detecting the driving state of a single reference organic EL display element 11z by sensing the current value of electric current supplied to the reference organic EL display element. Further, the current detecting means 13 has a single current detector Rref, a single operational amplifier A-2, and four resistors Rf1, Rf2, Rf3 and Rs interposed between the reference organic EL display element 11*z* and the stabilization voltage supply circuit 33.

The inverting input terminal of the operational amplifier A-2 is connected to the resistor so that an output of the operational amplifier A-2 is negative-fed back thereto. The inverting input terminal is also connected to the connecting point between the resistor Rf1 and the reference organic EL display element 11*z*. Further, the noninverting input terminal of the operational amplifier A-2 is connected to the connecting point between the current detecting resistor Rref and the stabilization voltage supply circuit 33 through the resistor Rs, and grounded through the resistor Rf3. With such a circuit configuration, the operational amplifier A-2 functions as a differential amplifier for converting a voltage developed across the current detecting resistor Rref into a current value signal V.

Incidentally, a pair of resistors Rf3 and Rs connected to the noninverting input terminal of the operational amplifier A-2 serves as voltage divider resistors for generating a partial voltage of the stabilization voltage Vout (Rref×Iref) Let Iref designate electric current flowing through the current detecting resistor Rref. Moreover, let α denote a dividing ratio (=Rf3/Rs), at which the stabilization voltage is divided by using the voltage dividing resistors Rf3 and Rs. Furthermore, in the case that Rf2=Rs (namely, α=Rf3/Rf2), and that Rf1=Rf3, the current value V represented by the current value signal is expressed by the equation (1):

$$V32\ (Rf3/Rf2)\times Rref\times Iref=\alpha\times Rref\times Iref \quad (1)$$

Further, the resistance value of the current detecting resistor Rref is set in such a manner as to be sufficiently small value in comparison with the resistance values of the segments Rz, Ra, Rb, . . . , Rn (Rm) of the segments (namely, the organic EL display elements 11*z*, 11*a* to 11*n*). Moreover, Iref·Rref is set in such a way as to be nearly equal to the forward voltage of the PNP transistor Q6 turned on and provided in each of the switching circuits 15 (15*a* to 15*n*), voltages respectively applied to the reference organic EL display element 11*z* and other segments (namely, the organic EL display elements 11*a*, . . . , 11*n*) can be made to be almost equal to one another.

The voltage control circuit 32 consists of a single operational amplifier A-1, a single resistor R1, and a Zener diode ZD1 serving as a single constant voltage element. The noninverting input terminal of the operational amplifier A-1 is connected to the cathode of the Zener diode ZD1 and grounded through the Zener diode ZD1. Further, the inverting input terminal of the operational amplifier A-1 is connected to the current detecting means 31. Furthermore, the operational amplifier A-1 is adapted to control an output thereof so that the voltage V (=α×Rref×Iref) applied from the current detecting means 31 to the noninverting input terminal thereof is made to be approximately equal to the backward voltage Vz provided thereto by being connected to the Zener diode ZD1. Further, the cathode of the Zener diode ZD1 is connected to the battery power supply (+B) through the resistor R11. Incidentally, the operational amplifier A-1 is adapted to ensure a positive power value of an output thereof, which value is sufficient to the extent that the transistor Q11 can output the voltage Vout at all times.

The stabilization voltage supply circuit 33 is practically constituted by a single NPN transistor Q11. Further, the circuit 33 converts the voltage Vin, which is supplied from the battery power supply (+B), to the stabilization voltage Vout serving as emitter potential, according to base potential provided from the voltage control circuit 32 to the circuit 33. Then, the circuit 33 outputs the voltage Vout to the switching circuits 15 (15*a* to 15*n*) and the current detecting resistor Rref of the current detecting means 31.

In the case of the proposed device example of the aforementioned configuration, first, when the voltage Vin is supplied from the battery power supply (+B) through the resistor R11 to the Zener diode ZD1 serving as a constant voltage element, the voltage at the noninverting input terminal of the operational amplifier A-1 of the voltage control circuit 32 is fixed by the Zener diode ZD1 at a constant voltage Vz. The operational amplifier A-1 outputs a stabilization adjustment signal, which is used for equalizing the voltage V to the constant voltage Vz, according to the voltage V(=α·Rref·Iref) supplied to the inverting input terminal thereof from the current detecting means 31 and to the constant voltage Vz.

The stabilization voltage supply circuit 33 (Q11) converts the instable power supply voltage Vin to the constant stable voltage Vout in response to a stabilization voltage adjustment signal outputted from the voltage control circuit 32.

At that time, in the case that the stabilization voltage Vout is supplied to the parallel connecting points in the organic EL display elements 11*z*, and 11*a* to 11*n*, the application voltage (namely, the stabilization voltage Vout) is equally applied to all the segments (namely, the organic EL display elements 11*z*, 11*a* to 11*n*). Thus, electric currents Im (Iref, Ia, Ib, . . . , In) each having a current value, which is in inverse proportion to the resistance values Rm of the segments, flow therethrough. In this way, the currents are automatically adjusted so that the current density becomes constant correspondingly to the area of each of the segments. Consequently, the luminance brightnesses of all the segments (namely, the organic EL display elements 11*z*, 11*a* to 11*n*) are stabilized without being affected by variation in the power supply voltage Vin.

Meanwhile, generally, the resistance values of the organic EL display elements 11*a* to 11*n*, 11*z* are changed owing to the deterioration of the display elements, which is caused over years of use, and to the change in the ambient temperature. However, in the case that the voltage to be applied to the organic EL display elements 11*a* to 11*n*, 11*z* is maintained at a fixed value, the current values of currents flowing through the organic EL display elements 11*a* to 11*n*, 11*z* change. This results in variation in the luminance brightness.

However, even in such a case, in this proposed device example, the luminance brightness of each of the organic EL display elements 11*a* to 11*n*, 11*z* is stably maintained by adjusting the voltage Vout according to the change in the resistance value of each of the elements 11*a* to 11*n*, 11*z*.

That is, the operational amplifier A-2 of the current detecting means 31 functions as a differential amplifier for converting a voltage developed across the current detecting resistor Rref into a current value signal V. Further, the operational amplifier A-2 outputs the current value signal V according to the equation (1) to the voltage control circuit 32. Moreover, as described above, a stabilization adjustment signal for equalizing the voltage V ($=\alpha\cdot Rref\cdot Iref$), which is supplied from the current detecting means 31 to the inverting input terminal, to the constant voltage value Vz is outputted by the operational amplifier A-1 of the voltage control circuit 32. The stabilization voltage supply circuit 33 (All) adjusts the voltage value of the stabilization voltage Vout according to an output of the voltage control circuit 32. That is, when the resistance (Rz) of the reference organic EL display element 11*z* lowers owing to the deterioration of the elements, the voltage Vout lowers. Conversely, when the resistance (Rz) rises, the voltage Vout rises. Needless to say, after the change in the resistance (Rz), the voltage control is performed so that the voltage V is stably maintained at a value of Vout even when the power supply voltage Vin changes.

Thus, even when the resistance (Rz) of the reference organic EL display element 11*z* changes owing to the deterioration thereof, the voltage Vout applied to each of the switching circuits 15 (15*a* to 15*n*) and the current detecting resistance Rref is adjusted, so that electric current supplied to each of the organic EL display elements 11*a* to 11*n* is stabilized thereby to maintain the brightness thereof at a constant value.

Incidentally, in the case that all the organic EL display elements 11*z*, 11*a* to 11*n* have nearly the same voltage-current characteristics and changes thereof with time, even when the internal resistances (Rz, Ra, Rb, . . . , Rn) of the segments change owing to the variation in the characteristics, the voltage Vout is controlled so that each of the driving currents Iref, Ia, Ib, . . . , In has a constant current value. Thus, change in the brightness of each of the display elements is small, in comparison with that in the case of employing a simple constant voltage driving method. Further, the difference in brightness among the segments is decreased.

Generally, when the organic EL display elements deteriorate with time, leakage current may abruptly increase in a part of segments. Thus, at an occurrence of an abnormal condition, such as an abrupt increase in leakage current, display segments, in each of which the abnormal condition occurs, stop emitting light. Moreover, an amount of heat generated by the wiring resistance of transparent electrodes of each of the organic EL display elements is increased. The generated heat adversely affects not only such abnormal display segments but also other normal display segments. Thus, the deterioration of the organic light emitting layers of surrounding display segments is promoted. Furthermore, the leakage current becomes an overcurrent, so that various kinds of drive circuits for driving display segments are destroyed. Thus, such destruction of the drive circuits may bring the entire EL display apparatus into an inoperative condition. The proposed device example cannot prevent an occurrence of such an inoperative condition thereof. Consequently, there is the necessity for improving the proposed device example.

Accordingly, the problem to be solved by the present invention is to provide a display element drive device adapted to impose certain limits on driving currents, which are supplied to display segments, even when the display segments are partly deteriorated and leakage current increases, thereby to contribute to the prevention of heat generation and destruction of various kinds of drive circuits.

To solve the foregoing problems, according to a first aspect of the present invention, there is provided a display element drive device for driving a single EL display element or a plurality of EL display elements parallel-connected to one another, which comprises a single stabilization voltage supply circuit for applying a stabilization voltage to the EL display element, a reference EL display element parallel-connected to the EL display element, driving state detecting means for detecting a driving state and for changing an output signal according to the driving state, a voltage control circuit for controlling a constant voltage by supplying a stabilization voltage adjustment signal to the stabilization voltage supply circuit according to the output signal of the driving state detecting means so that the driving state of the reference EL display element is constant, and a switching circuit for switching between application and disapplication of the stabilization voltage to the EL display element. In the device, at least one of the stabilization voltage supply circuit and the switching circuit has a transistor for supplying a driving current to the EL display element. The transistor is connected to a current detecting element for detecting a collector current of the transistor, and to a bias suppressing element for reducing a base-emitter bias of the transistor by on-switching when the current detected by the current detecting element rises to a certain abnormal level owing to leakage current of the EL display element.

According to a second aspect of the present invention, there is provided a display element drive device for driving a single EL display element or a plurality of EL display elements parallel-connected to one another, which comprises a single stabilization voltage supply circuit for applying a stabilization voltage to the EL display element, a reference EL display element parallel-connected to the EL display element, a control portion for detecting a driving state and for changing a control signal, which is used to control the stabilization voltage, according to the driving state, a voltage control circuit for controlling a constant voltage by supplying a stabilization voltage adjustment signal to the stabilization voltage supply circuit according to the control signal outputted from the control portion so that the driving state of the reference EL display element is constant, and a switching circuit for switching between application and disapplication of the stabilization voltage to the EL display element. In the device, the switching circuit is adapted to perform on-off switching according to a switching signal sent from the control portion. The stabilization voltage supply circuit has a stabilization voltage supply element for adjusting an output level of the stabilization voltage according to the stabilization voltage adjustment signal supplied from the voltage control circuit, and further has a current detecting element for detecting a current outputted from the stabilization voltage supply element. The control portion has a function of outputting to the switching circuit a switching signal for applying the stabilization voltage to the EL display element by on-switching of the switching circuit. The control portion further has a function of judging that leakage current of the EL display element abnormally increases, and changing the control signal to thereby limit the output level of the stabilization voltage outputted from the stabilization voltage supply element when the current detected by the current detecting element rises to an abnormally high level in comparison with a level of a driving current needed for driving the EL display element to emit light in a case that the on-switching of the switching circuit is performed in response to the switching signal.

DETAILED DESCRIPTION OF THE PREFERRED EMBODIMENTS

First Embodiment

<Configuration>

Figure 1:
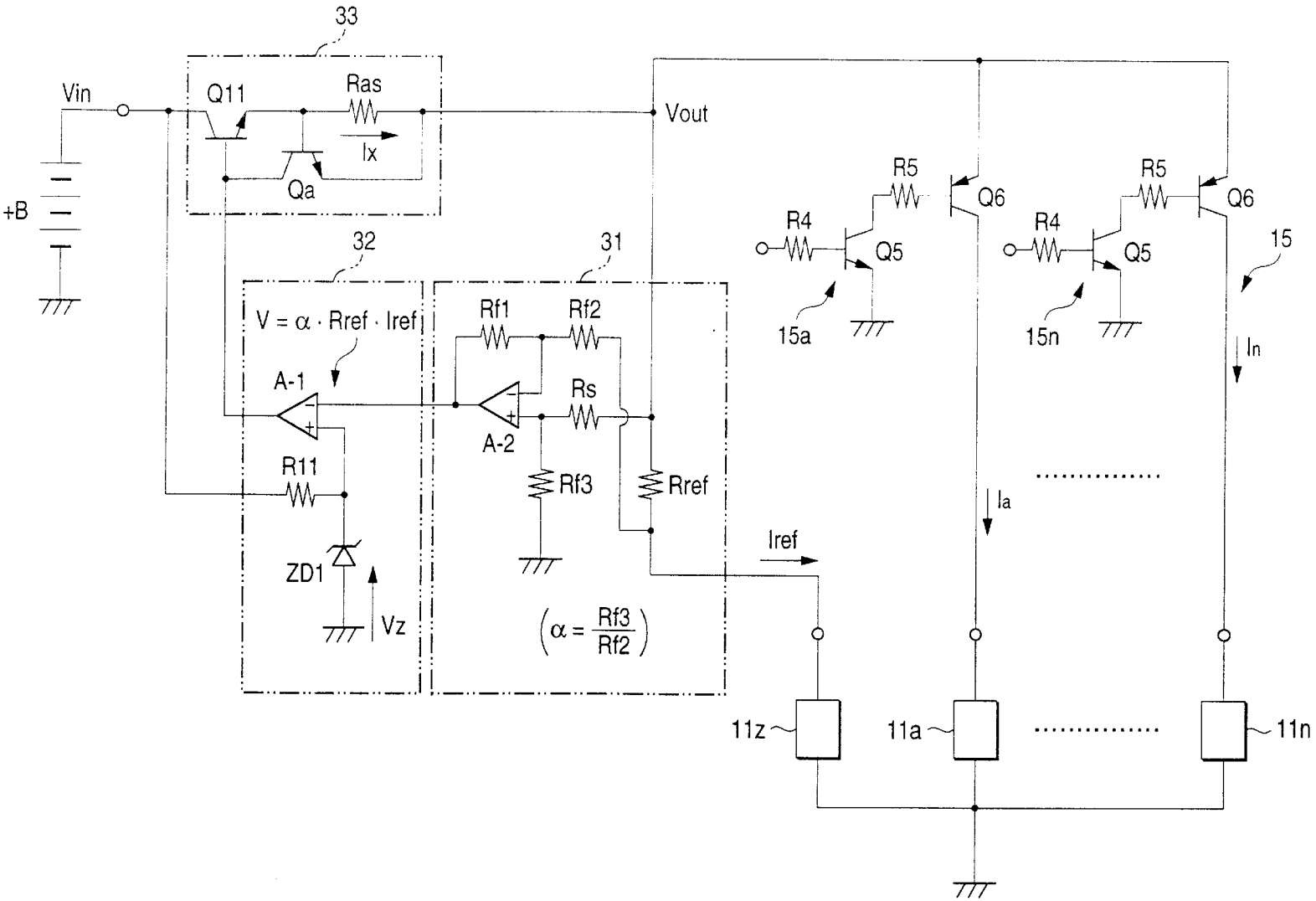
FIG. 1 is a circuit diagram illustrating a display element drive device according to a first embodiment of the present invention.

FIG. 1 is a circuit diagram illustrating a display element drive device according to a first embodiment of the present invention. Incidentally, in FIG. 1, like reference characters designate constituent elements each having the same functions as those of like constituent elements of the proposed device example illustrated in FIG. 10.

The display element drive device employs a constant voltage driving method as a method of driving a plurality of fixed segment organic EL display elements 11*a* to 11*n* as shown in FIG. 1. Thus, a plurality of conventional driving reference sources (current sources) needed due to the difference among the areas of the display elements in the conventional device are omitted. Moreover, the segments are adapted to have the same brightness. Especially, the stabilization voltage Vout to be supplied to the organic EL display elements 11*a* to 11*n* is eventually suppressed by providing a transistor (namely, a bias suppressing element) Qa and a current sensing resistor (namely, a current detecting element) Ras between the base and emitter of an NPN transistor (namely, a switching element) Q11 of the stabilization voltage supply circuit 33, so that when leakage current of a given segment increases, the voltage developed across the current sensing resistor Ras increases, that thus the transistor Qa is turned on, and that the base-emitter bias of the NPN transistor (namely, the switching element) Q11 is lowered.

Figure 9:
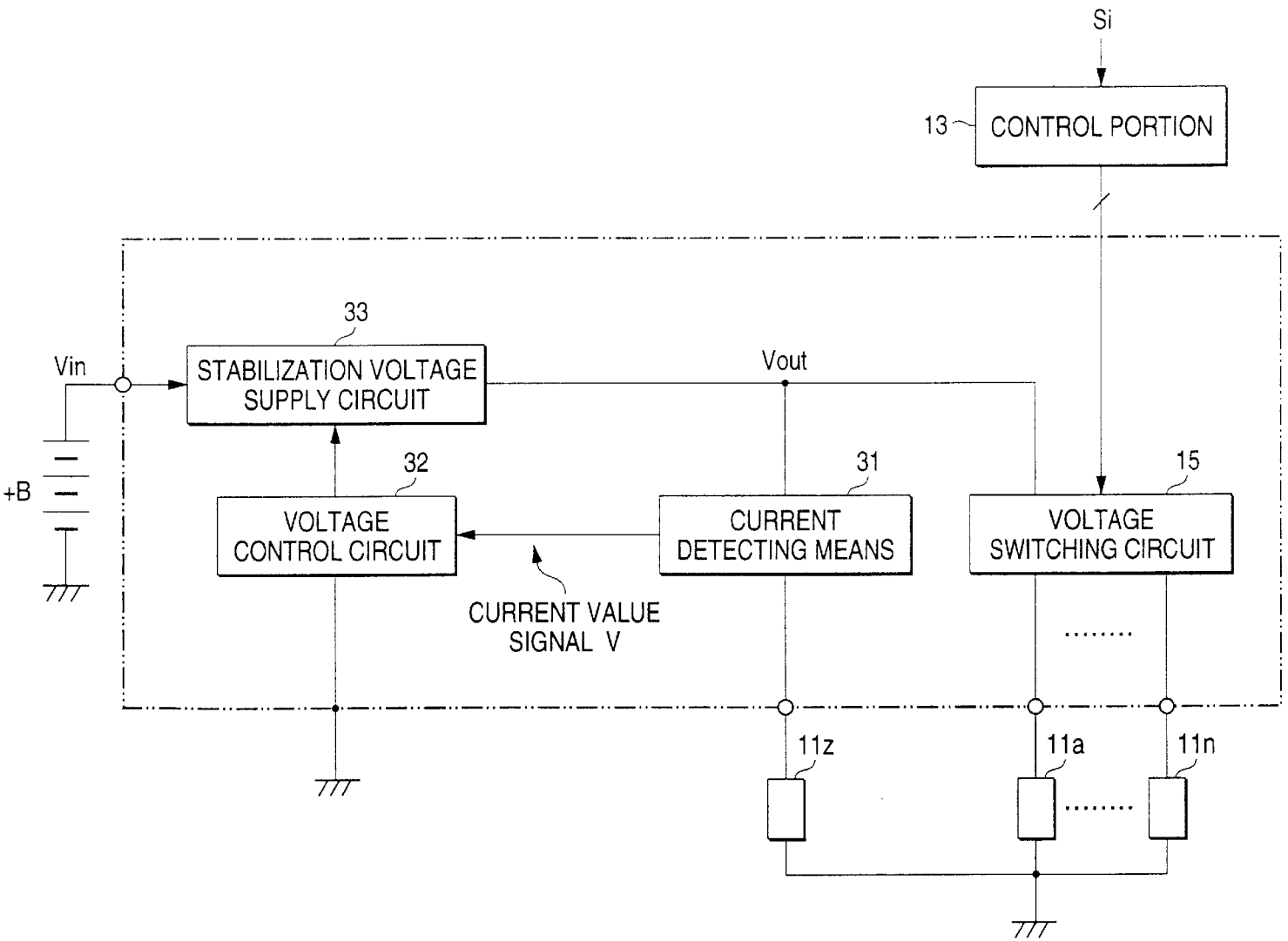
FIG. 9 is a block diagram illustrating a display element drive device that is a proposed device example and the first embodiment.

Similarly as the proposed device example illustrated in FIG. 9, to deal with variation in characteristics and secular changes thereof in the case of applying a constant voltage to the EL display elements, the display element drive circuit of this embodiment comprises a current detecting means 31 (namely, a driving state detecting means) for detecting the current value Iref of electric current supplied to a specific organic EL display element (hereunder referred to as "reference organic EL display element") 11*z* (namely, a reference light emitting element) other than the organic EL display elements 11*a* to 11*n*, and for outputting a current value signal varying according to the current value Iref, a voltage control circuit 32 for converting a current value signal received from the current detecting means 31 into a stabilization voltage adjustment signal, and a stabilization voltage supply circuit 33 for converting a voltage Vin supplied from an instable battery power supply (+B) into a constant stabilization voltage Vout according to a stabilization voltage adjustment signal received from the voltage control circuit 32.

Incidentally, the individual organic EL display elements 11*a* to 11*n* serving as display segments may differ from one another in the display area thereof. In this case, each of appropriate driving currents Ia to In for a corresponding one of the organic EL display elements 11*a* to 11*n* is in proportion to the area of an anode electrode thereof. In this embodiment, the organic EL display elements 11*a* to 11*n* and the reference organic EL display element 11*z* are parallel-connected to the stabilization voltage Vout. Even when the organic EL display elements 11*a* to 11*n* and 11*z* have differ from one another in the display area, each of the organic EL display elements is adapted to be supplied with a corresponding one of the driving currents Ia to In, Iref, which is appropriate for the display area thereof.

Figure 10:
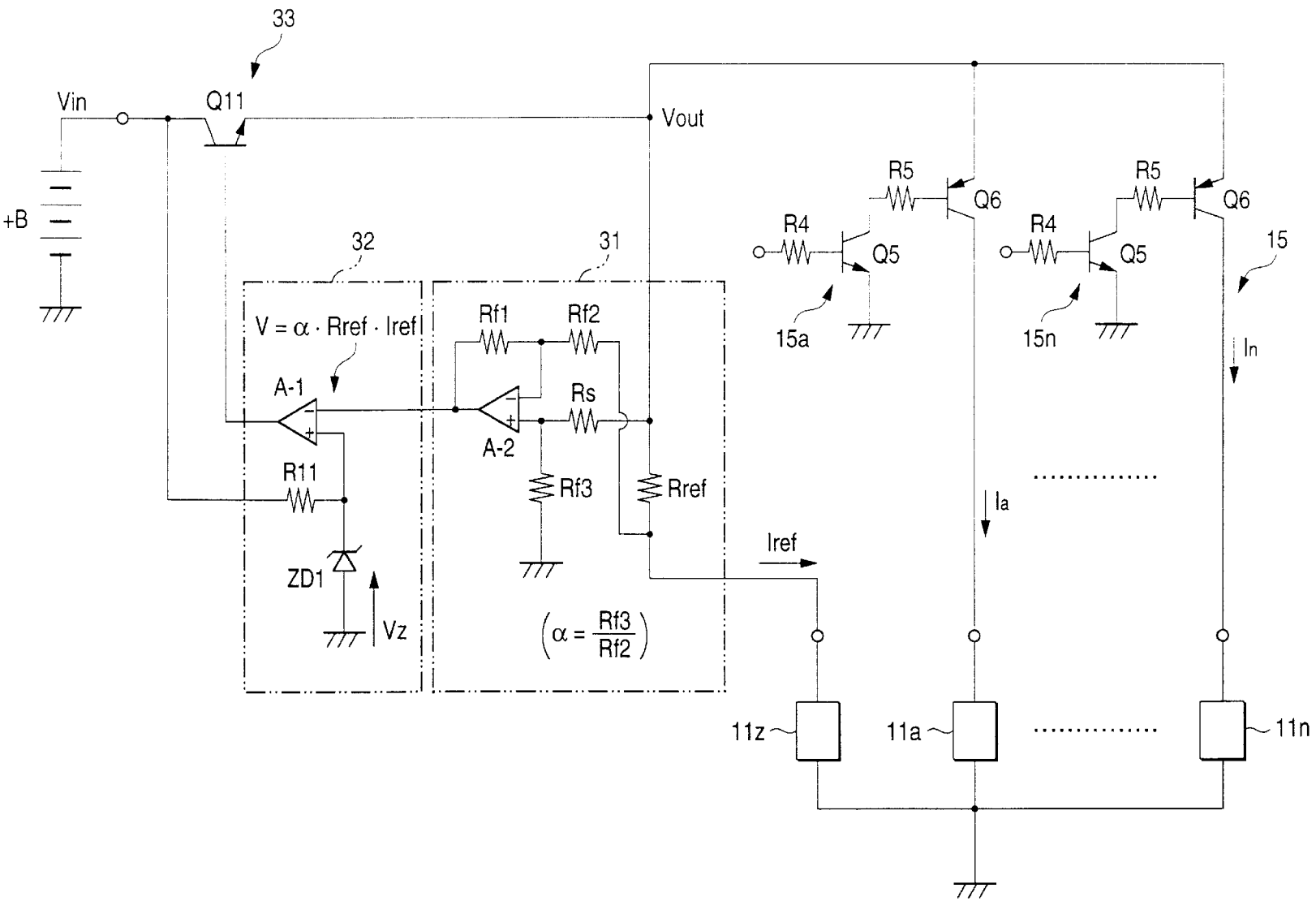
FIG. 10 is a circuit diagram illustrating the display element drive device of the proposed device example.

Incidentally, the configurations of the organic EL display elements 11*a* to 11*n*, 11*z*, the switching circuits 15 (15*a* to 15*n*), the current detecting means 31, and the voltage control circuit 32 are similar to those of such components of the proposed device example shown in FIG. 10. Therefore, the descriptions thereof are omitted herein.

The stabilization voltage supply circuit 33 practically comprises a single NPN transistor Q11, a current sensing resistor Ras, disposed at the side of the emitter of the NPN transistor Q11, for detecting a change in a total current Ix on outputting the stabilization voltage Vout, and an NPN transistor Qa, placed between the base and emitter of the NPN transistor Q11, for on-switching when the voltage developed across the current sensing resistor Ras increases.

The NPN transistor Q11 serves as a switching element that is operative to convert the voltage Vin supplied from the battery power supply (+B) into the stabilization voltage Vout serving as emitter potential thereof according to base potential provided from the voltage control circuit 32, and that outputs the voltage signal Vout to all the switching circuits 15 (15*a* to 15*n*) and the current detecting resistor Rref of the current detecting means 31.

When leakage current of a given one of the organic EL display elements 11*a* to 11*n* increases, the total current Ix flowing through the current sensing resistor Ras increases. Thus, the current sensing resistor Ras is adapted to increase the drop voltage thereacross at that time.

The NPN transistor Qa has a base connected to the emitter of the NPN transistor Q11 and a terminal of the current sensing resistor Ras, and also has a collector connected to the base of the NPN transistor Q11, and further has an emitter connected to the other terminal of the current sensing resistor Ras. The NPN transistor Qa is held in an off-state in the case that the drop voltage (Ras×Ix) across the current sensing resistor Ras is less than a predetermined value. Further, the base-emitter bias of the NPN transistor Q11 is lowered by the on-switching of the transistor when the drop voltage (Ras×Ix) increases. Consequently, the output voltage Vout and the total current Ix of electric current flowing through the organic EL display elements 11*a* to 11*z* are suppressed. Incidentally, when the NPN transistor Qa is turned on, the collector current of the NPN transistor Qa flows out and joins the current Ix. Resultant current is supplied to each of the organic EL display elements 11*a* to 11*z*. Thus, strictly speaking, a total current value of the driving currents of the organic EL display elements 11*a* to 11*z* is more than Ix. However, when the NPN transistor Qa is turned on, the voltage developed across the current sensing resistor Ras falls, with the result that the NPN transistor Qa is turned off again. Such an operation is repeated, so that the collector current of the NPN transistor Qa is suppressed to a low level that is negligible in comparison with the total current Ix.

When the voltage Vin supplied from the battery power supply (+B) is applied through the resistor R11 to the cathode of the Zener diode ZD1 acting as the constant voltage element in the display element drive circuit of the aforementioned configuration, the voltage at the noninverting input terminal of the operational amplifier A-1 of the voltage control circuit 32 is fixed at a constant voltage Vz by the Zener diode ZD1. At that time, the operational amplifier A-1 outputs a stabilization adjustment signal, according to which the voltage V(=α·Rref·Iref) is equalized almost to the constant voltage Vz.

The stabilization voltage supply circuit 33 is operative to convert the instable power supply voltage Vin into the constant stabilization voltage Vout according to the stabilization voltage adjustment signal sent from the voltage control circuit 32, and to then output the voltage Vout.

In the case that each of the organic EL display elements 11*a* to 11*n* is in a normal state and thus the total current Ix flowing through the current sensing resistor Ras is less than a certain level at that time, the drop voltage (Ras×Ix) across the current sensing resistor Ras is less than a predetermined value. Consequently, the NPN transistor Qa is held in an off-state.

Incidentally, when the stabilization voltage Vout is applied to the parallel connecting points in the organic EL display elements 11*z*, 11*a* to 11*n*, the application voltage (namely, the stabilization voltage Vout) is equally applied to all the segments (namely, the organic EL display elements 11*z*, 11*a* to 11*n*). Thus, electric currents Im (Iref, Ia, Ib, . . . , In) each having a current value, which is in inverse proportion to the resistance values Rm of the segments, flow therethrough. In this way, the currents are automatically adjusted so that the current density becomes constant correspondingly to the area of each of the segments is constant. Consequently, the luminance brightnesses of all the segments (namely, the organic EL display elements 11*z*, 11*a* to 11*n*) are stabilized without being affected by variation in the power supply voltage Vin.

Meanwhile, when the resistance values of the organic EL display elements 11*a* to 11*n*, 11*z* are changed owing to the deterioration of the display elements, which is caused over years of use, and to the change in the ambient temperature, the value of the voltage Vout is adjusted, similarly as in the case of the proposed device example. That is, the operational amplifier A-2 of the current detecting means 31 functions as a differential amplifier for converting the voltage developed across the current detecting resistor Rref into a current value signal V. Further, the operational amplifier A-2 outputs the current value signal V according to the equation (1) to the voltage control circuit 32. Furthermore, as described above, a stabilization adjustment signal for equalizing the voltage V (=α·Rref·Iref), which is supplied from the current detecting means 31 to the inverting input terminal, nearly to the constant voltage value Vz is outputted by the operational amplifier A-1 of the voltage control circuit 32.

When the total current Ix flowing through the current sensing resistance Ras is less than a certain level, the NPN transistor Qa is held in an off-state, as described above. Thus, the stabilization voltage supply circuit 33 adjusts the voltage value of the stabilization voltage Vout according to an output of the voltage control circuit 32. That is, when the resistance (Rz) of the reference organic EL display element 11*z* lowers, the voltage Vout lowers. Conversely, when the resistance (Rz) rises, the voltage Vout rises. Thus, the current flowing through the organic EL display elements 11*a* to 11*n* is stabilized, and the brightness thereof can be maintained at a constant level.

When leakage current is generated by the partial deterioration of the organic EL display elements 11*a* to 11*n*, 11*z* in the state, and the total current Ix flowing through the current sensing resistor Ras increases in such a manner as to be equal to or more than a certain level, the drop voltage (Ras×Ix) increases. Thus, the base-emitter bias of the NPN transistor Q11 is lowered by the on-switching of the transistor. Consequently, the output voltage Vout and the total current Ix of electric current flowing through the organic EL display elements 11*a* to 11*z* are suppressed. Incidentally, when the NPN transistor Qa is turned on, the collector current of the NPN transistor Qa flows out and joins the current Ix. Resultant current is supplied to each of the organic EL display elements 11*a* to 11*z*. Thus, strictly speaking, a total current value of the driving currents of the organic EL display elements 11*a* to 11*z* is more than Ix. However, when the NPN transistor Qa is turned on, the voltage developed across the current sensing resistor Ras falls, with the result that the NPN transistor Qa is turned off again. Such an operation is repeated, so that the collector current of the NPN transistor Qa is suppressed to a low level that is negligible in comparison with the total current Ix.

Thus, even when the organic EL display elements 11*a* to 11*n* are partly deteriorated and thus the magnitude of leakage current increases, heat generation and destruction of components owing to heat and overcurrent are prevented by imposing certain limits on the total driving current Ix supplied to the organic EL display elements 11*a* to 11*z*.

Second Embodiment

<Configuration>

Figure 2:
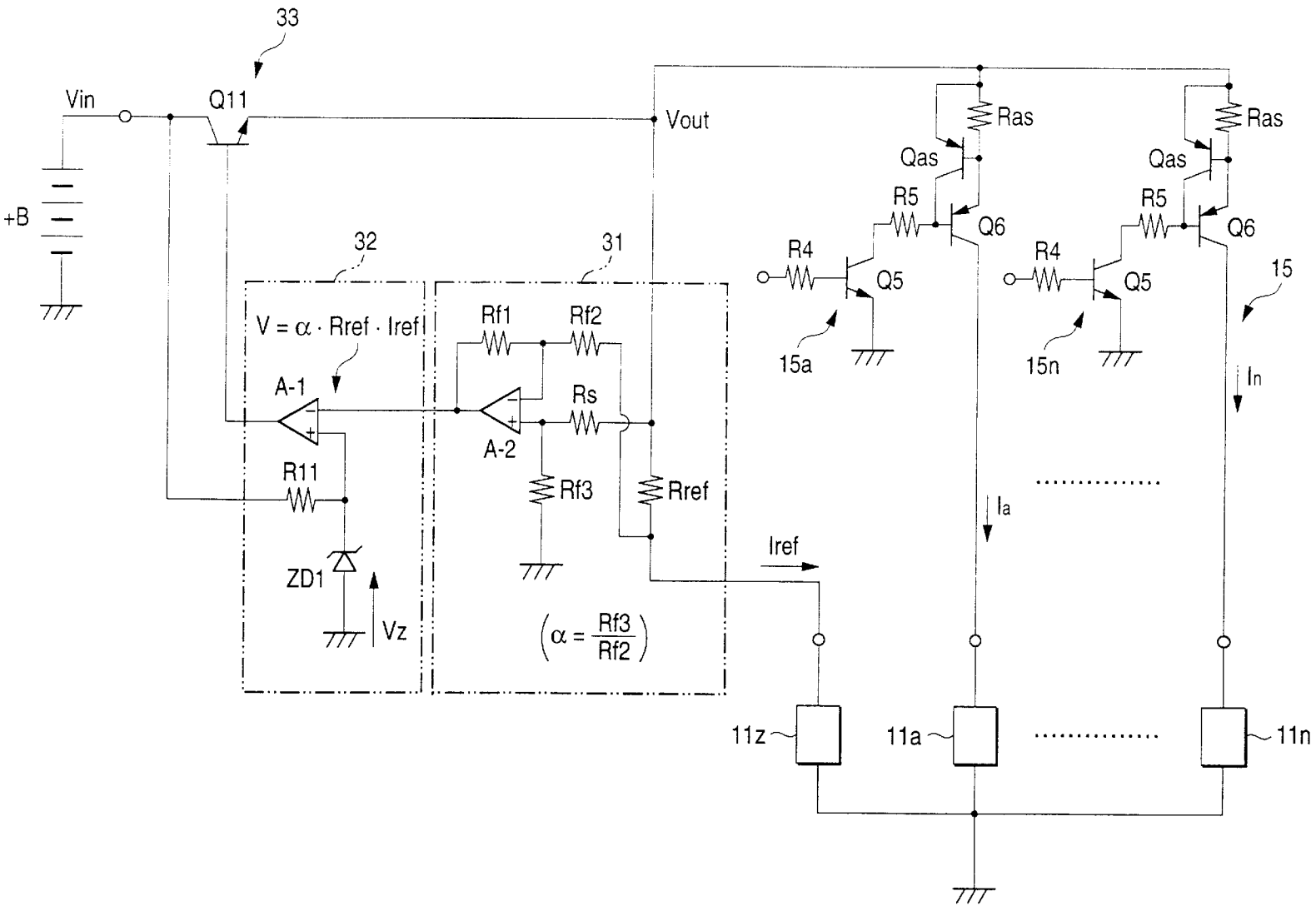
FIG. 2 is a circuit diagram illustrating a display element drive device according to a second embodiment of the present invention.

FIG. 2 is a circuit diagram illustrating a display element drive device according to a second embodiment of the present invention. Incidentally, in FIG. 2, like reference characters designate constituent elements each having the same functions as those of like constituent elements of the first embodiment.

In the case of the first embodiment, when at least one of the organic EL display elements 11*a* to 11*n* is defective, the output voltage Vout is suppressed and lowered during the defective one of the organic EL display elements 11*a* to 11*n* emits light, as described above. Thus, the first embodiment is advantageous in that the generation of overcurrent is prevented in the case that the defective one of the organic EL display elements 11*a* to 11*n* singly emits light. However, in the case that other normal organic EL display elements 11*a* to 11*n* are driven, simultaneously with the driving of the defective one of the organic EL display elements 11*a* to 11*n*, the drop of the output voltages Vout affects the driving operation of the normal ones of the organic EL display elements 11*a* to 11*n* emitting light. Thus, the luminance brightness of the entire display apparatus may be lowered.

Thus, as illustrated in FIG. 2, in the display element drive device of this embodiment, a PNP transistor (or bias suppressing element) Qas and a current sensing resistor (or current detecting element) Ras are connected between the base and emitter of each of PNP transistors (or switching elements) Q6 of the switching circuits 15 respectively corresponding to the individual organic EL display elements 11*a* to 11*n*. Consequently, the driving currents Ia to In of the organic EL display elements 11*a* to 11*n* can be individually suppressed.

The PNP transistors Q6 are operative to switch on and off the supply of the current Ia to In flowing from the stabilization supply circuit 33 to the organic EL display elements 11*a* to 11*n*. Each of the NPN transistors Q5 is turned on according to a selection signal provided from the control portion 13 of FIG. 9 through the resistor R4. In response to this, the base potential of the PNP transistor Q6 connected to the collector of the NPN transistor Q5 through the resistor R5 becomes low. Then, the state of the PNP transistor Q6 is changed into an on-state.

The current sensing resistor Ras is adapted so that the drop voltage developed thereacross increases in the case that the leakage current of a corresponding one of the organic EL display elements 11*a* to 11*n* increases and the corresponding one of the driving currents 11*a* to 11*n* rapidly increases when a corresponding one of the driving currents Ia to In flows therethrough during the corresponding PNP transistor Q6 is in an on-state.

The PNP transistor Qas is held in an off-state in the case that the drop voltage (Ras×Ix) across the current sensing resistor Ras is less than a predetermined value. Further, the base-emitter bias of the PNP transistor Q6 is lowered by the on-switching of the transistor when the drop voltage increases. Consequently, the driving currents Ia to In flowing through the organic EL display elements 11*a* to 11*z* are suppressed.

The rest of the configuration of this embodiment is similar to the corresponding part of the proposed drive example.

The display element drive circuit of this embodiment current-limits each of the organic EL display elements 11*a* to 11*z* by suppressing the base-emitter voltage of the switching element Q6 of a corresponding one of the switching circuits 15*a* to 15*n*. Thus, even when the defective ones of the organic EL display elements 11*a* to 11*z* and other normal ones thereof are simultaneously driven and emit light, the stabilization voltage Vout can be maintained at a constant value. Moreover, overcurrent can be prevented correspondingly to each of the organic EL display elements 11*a* to 11*n*. As compared with the first embodiment, the second embodiment can prevent the defective ones of the organic EL display elements 11*a* to 11*n* from adversely affecting the normal ones thereof.

Third Embodiment

<Configuration>

Figure 3:
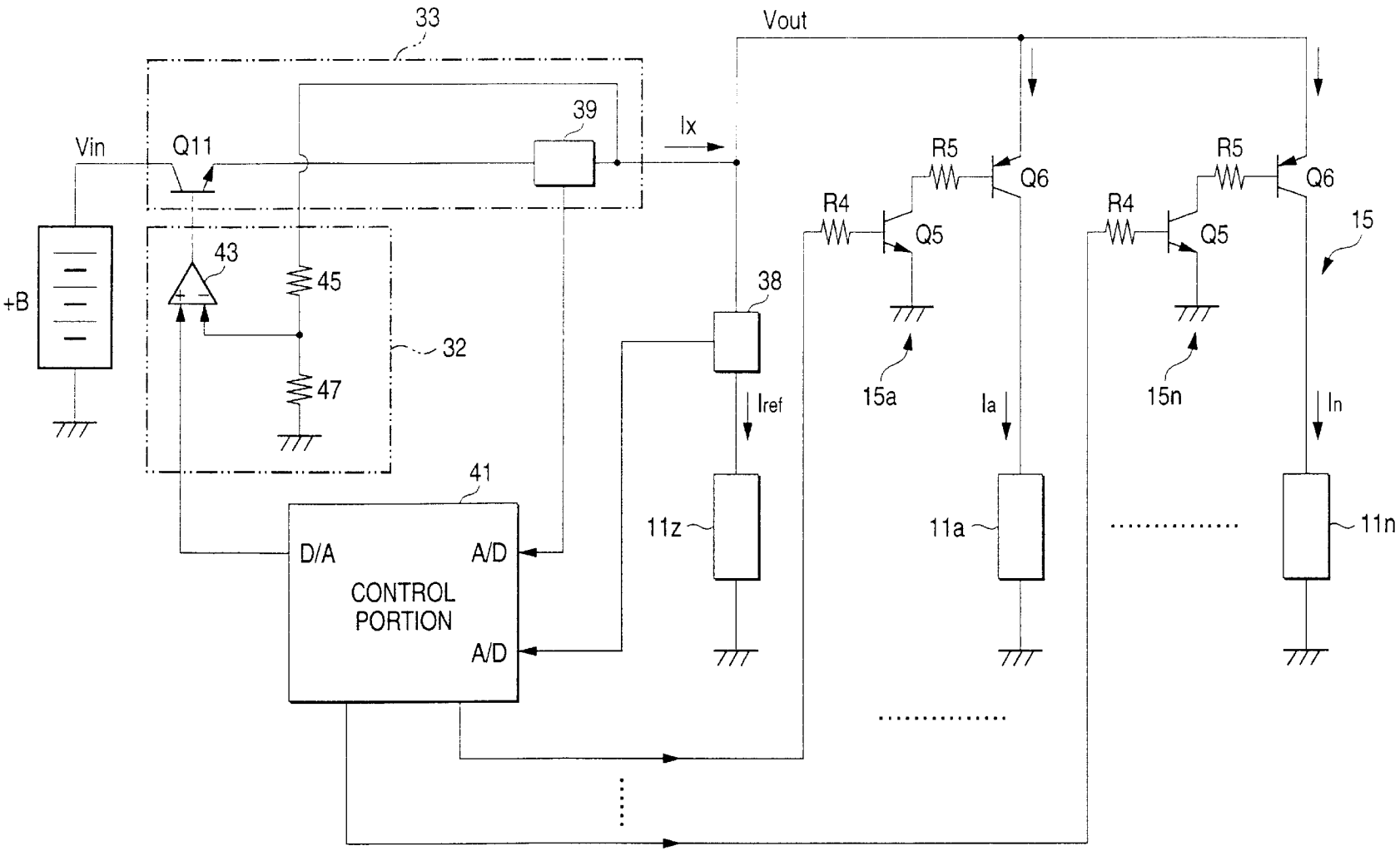
FIG. 3 is a block diagram illustrating a display element drive device according to a third embodiment of the present invention.

FIG. 3 is a circuit diagram illustrating a display element drive device according to a third embodiment of the present invention. Incidentally, in FIG. 3, like reference characters designate constituent elements each having the same functions as those of like constituent elements of the first and second embodiments.

The display element drive device of the third embodiment sets current limit values as being variable according to the turned-on states of the organic EL display elements 11*a* to 11*n*.

Practically, the display element drive device of this embodiment is adapted so that a control signal is provided from the control portion 41, which uses a microcomputer chip having a CPU, a ROM, and a RAM, and that the stabilization voltage Vout supplied from the stabilization voltage supply circuit 33 is controlled according to the control signal. More particularly, the drive device is adapted so that the control portion 41 detects a driving current Iref flowing through a first current-voltage converting circuit 38 interposed between the reference organic EL display element 11*z* and the stabilization voltage supply circuit 33, that a second current-voltage converting circuit detects a sum total (namely, the total current Ix) of the driving currents Ia to In, and Iref flowing therethrough when the stabilization voltage Vout is applied thereto, and that both the voltage control circuit 32 and the stabilization voltage supply circuit 33 are controlled according to results of both the detection operations.

The voltage control circuit 32 comprises a single operational amplifier 43, and a pair of voltage dividing resistors 45 and 47 for detecting the voltage level of the stabilization voltage Vout supplied from the stabilization voltage supply circuit 33. Further, the control signal supplied from the control portion 41 is inputted to the noninverting input terminal of the operational amplifier 43. Thus, the circuit 32 is controlled by the control portion 41. Moreover, a signal representing the potential at the connecting point between both the voltage dividing resistors 45 and 47 is inputted to the inverting input terminal of the operational amplifier 43 thereby to prevent a change in the stabilization voltage Vout. Thus, the luminance brightnesses of all the segments (namely, the organic EL display elements 11*z*, 11*a* to 11*n*) are stabilized without being affected by variation in the power supply voltage Vin.

The stabilization voltage supply circuit 33 practically comprises a single NPN transistor (namely, a stabilization voltage supply element) Q11, and a second current-voltage converting circuit 39, connected to the output side of the NPN transistor Q11, for detecting an amount of the total current Ix outputted from the NPN transistor Q11. The stabilization voltage Vout is outputted by the voltage drop in the transistor Q11 and the second current-voltage converting circuit 39. Especially, the NPN transistor Q11 is operative to adjust a voltage drop amount corresponding to the voltage Vin supplied from the battery B according to a base input signal supplied from the voltage control circuit 32.

Figure 4:
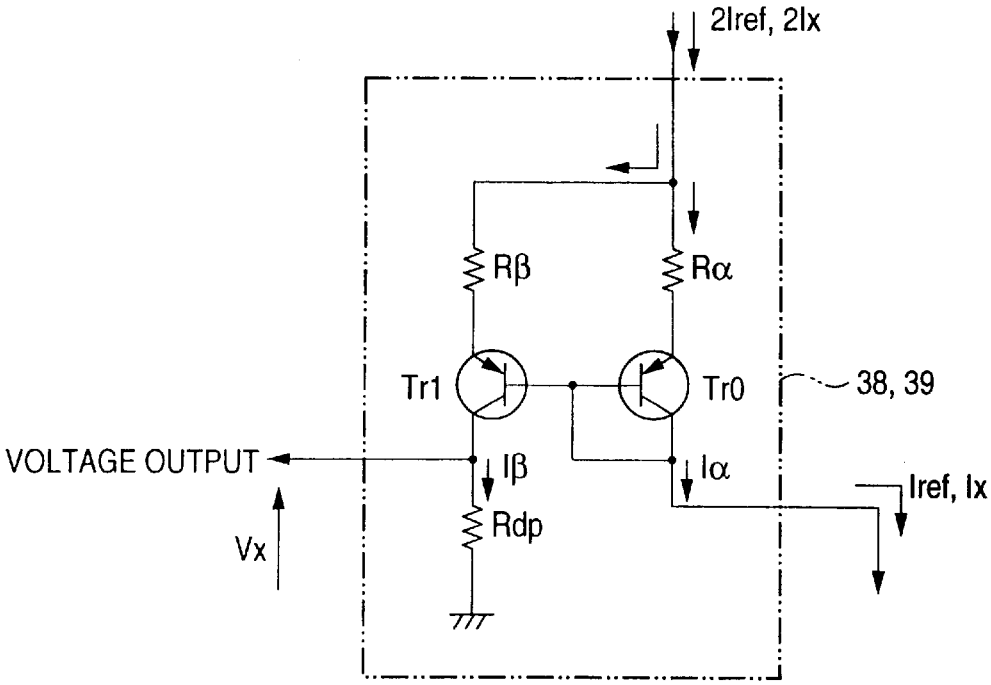
FIG. 4 is a circuit diagram illustrating the internal configuration of a current-voltage converting circuit in the display element drive device according to the third embodiment of the present invention.
Figure 5:
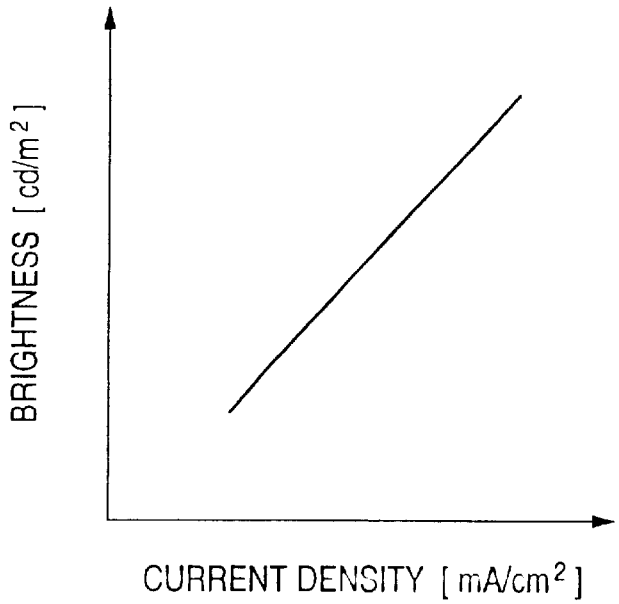
FIG. 5 (Prior Art)
FIG. 5 is a diagram illustrating a conventional display element drive device.
Figure 6:
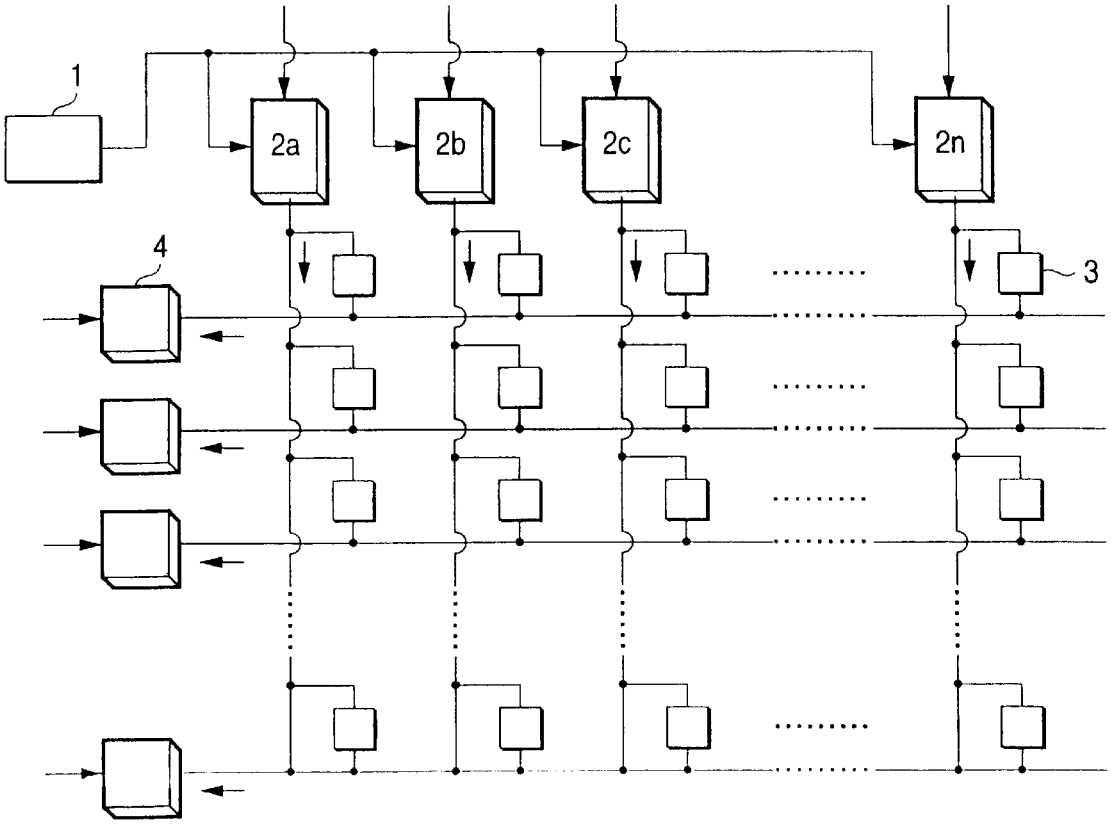
FIG. 6 (Prior Art)
FIG. 6 is a diagram illustrating a conventional display element drive device.
Figure 7:
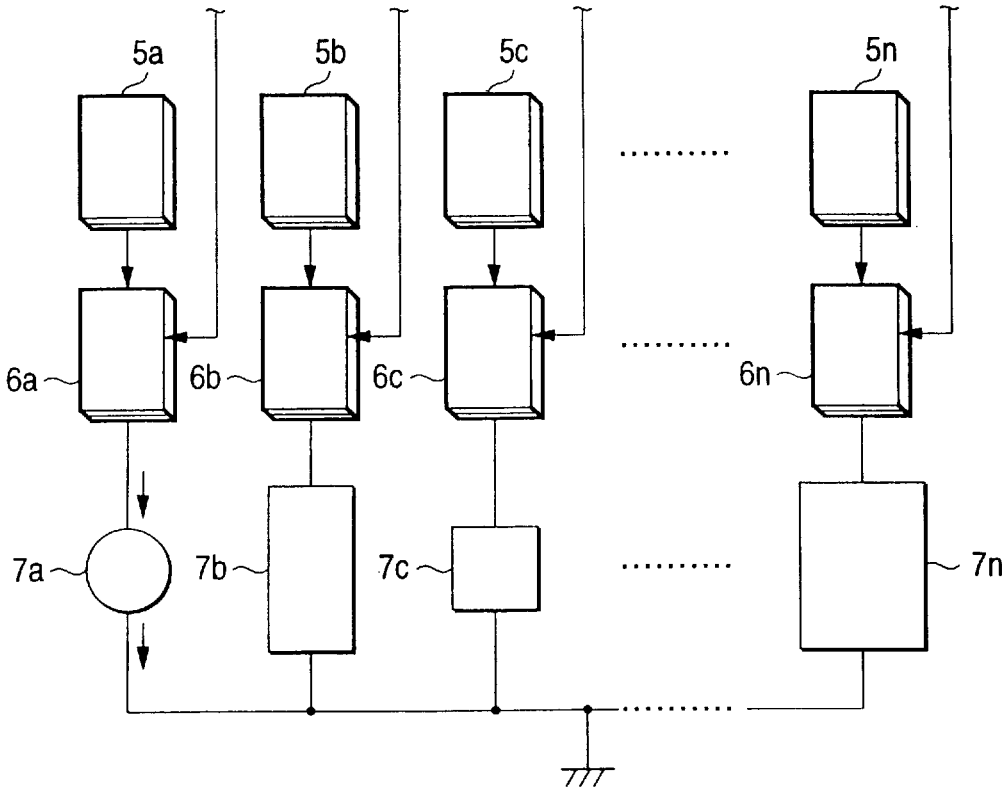
FIG. 7 (Prior Art)
FIG. 7 is a diagram illustrating a conventional display element drive device.
Figure 8:
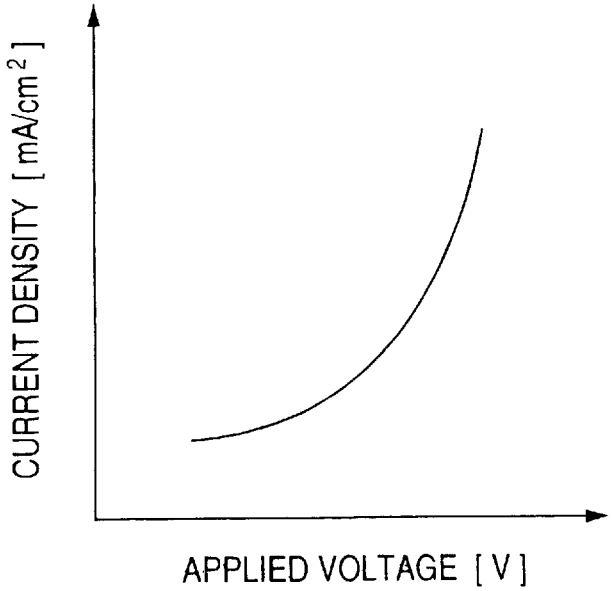
FIG. 8 is a graph illustrating the relation between the applied voltage and the current density of an EL display element.

FIG. 4 illustrates the configuration of an example of a set of the current-voltage converting circuits 38 and 39. The first current-voltage converting circuit 38 is provided so as to monitor the driving current Iref of the reference organic EL display element 11*z* as an alternate measure instead of directly detecting the driving currents Ia to In of the organic EL display elements 11*a* to 11*n* so as to compensate for a temperature-dependent change in the brightness and a time-dependent change in characteristics of the display elements 11*a* to 11*n*. On the other hand, the second current-voltage converting circuit 39 is used to detect variation in the total current Ix supplied to all the organic EL display elements 11*a* to 11*n* when the stabilization voltage Vout is supplied thereto. Despite the difference in purpose of installation thereof, circuits of a similar configuration illustrated in FIG. 4 can be used. In the case of the example of FIG. 4, current mirror circuits are used as the current-voltage converting circuits 38 and 39. A pair of PNP transistors Tr0 and Tr1 has the same characteristics. Currents (2Iref, 2Ix) inputted to the current-voltage converting circuits 38 and 39 are equally divided into two parts as collector currents Iα and Iβ of the transistors Tr0 and Tr1. Between the currents Iα0 and Iβ obtained, a collector current Iα outputted from one Tr0 of the transistors is outputted as a driving current Iref, or a total current Ix. A collector current Iβ outputted from the other Tr1 of the transistors is outputted to a predetermined pull-down resistor Rpd. A voltage Vx at the connecting point between the pull-down resistor Rpd and the collector of the transistor Tr1 is inputted to the control portion 41. Consequently, the control portion 41 can detect the driving current Iref and the total current Ix with good accuracy. Incidentally, in FIG. 4, reference characters Rα and Rβ designate resistors connected to the emitters of the transistors Tr0 and Tr1, respectively.

In this case, the collector currents are calculated as follows by assuming that the amplification factors of the transistors Tr0 and Tr1 are sufficiently large.

$$I\alpha \times R\alpha = I\beta \times R\beta$$

Thus, $$I\alpha = I\beta \times R\beta / R\alpha \quad (2)$$

Further, the voltage detected by the control portion 41 is given by $$Vx = I\beta \times Rpd$$

Thus, $$I\beta = Vx / Rpd \quad (3)$$

Substituting the equation (3) for the equation (2), $$I\alpha = Vx \times R\beta / (R\alpha \times Rpd) \quad (4)$$

The control portion 41 can easily compute the collector current Iα (that is, the driving current Iref or the total current Ix) of the transistor Tr0 according to the detected voltage Vx by using the equation (4).

The control portion 41 detects the driving current Iref supplied to the reference organic EL display element 11*z* according to the equation (4), based on the voltage outputted from the first current-voltage converting circuit 38. Then, the control portion 41 adjusts the stabilization voltage Vout, which is outputted from the stabilization voltage supply circuit 33, in a direction, in which the driving current Iref is constant, by changing the control signal, which is supplied to the voltage control circuit 32, according to the value of the driving current Iref. Consequently, the stabilization voltage Vout is stabilized.

Further, the control portion 41 detects the total current Ix according to the equation (4), based on the voltage (see Vx in the equation (4)) outputted from the second current-voltage converting circuit 39. The, the control portion 41 compares the detected total current Ix with a predetermined reference value. Subsequently, the control portion 41 generates a control signal serving as a digital signal, according to the equation (4). Then, the control portion 41 performs a D/A (digital/analog) conversion on the control signal and outputs a resultant signal to the voltage control circuit 32.

Incidentally, the control portion 41 detects the output voltage of the second current-voltage converting circuit 39 so as to ascertain variation in amount of the total current Ix flowing through the circuit 39. In the case that one or more switching circuits 15*a* to 15*n* are turned on in response to a switching signal outputted from the control portion 41 to drive and cause one or more organic EL display elements 11*a* to 11*n* to emit light, the control portion 41 computes and sets a reference value that is commensurate with a sum of the display areas of these organic EL display elements 11*a* to 11*n* and the reference organic EL display element 11*z*. Then, the control portion 41 compares the reference value computed and set herein with a detection value detected across the second current voltage converting circuit 39. When the detection value far exceeds the reference value, the total current Ix outputted from the stabilization voltage supply circuit 33 is limited by reducing a control signal transmitted to the noninverting input terminal of the operational amplifier 43 of the voltage control circuit 32. In this embodiment, practically, when the detection value is twice the reference value or more, the control portion 41 judges that an abnormal condition occurs. Then, the control portion 41 reduces the control signal.

Thus, when leakage current of one of the organic EL display elements 11*a* to 11*n* increases, the total current Ix is suppressed within a certain level in the case that the total current Ix flowing through the second current-voltage converting circuit 39 increases to a level that is equal to or more than a certain predetermined level, and that thus, the output voltage of the second current-voltage converting circuit 39 increases.

For example, in the case that the appropriate driving current Ia of the first organic EL display element 11*a* is 10 mA, that the appropriate driving current In of the nth organic EL display element 11*n* is 15 mA, and that the appropriate driving current Iref of the reference organic EL display element 11*z* is 1 mA, when the control portion 41 performs the on-switching of the two switching circuits 15*a* and 15*n* to thereby turn on these switching circuits and to drive and cause the organic EL display elements 11*a* and 11*n* to emit light, the proper current level of the total current Ix is a sum of 10 mA, 15 mA, and 1 mA, that is, 26 mA (10 mA+15 mA+1 mA=26 mA). In this case, the control portion 41 sets the reference value at 52 mA (=26×2), which is a current level that is twice the proper current level 26 mA. When the total current Ix flowing through the second current-voltage converting circuit 39 increases to a value that is equal to or more than 52 mA, the control portion 41 becomes aware of an abnormal condition, and then reduces a control signal outputted to the voltage control circuit 32 so that the total current Ix is suppressed in such a manner as to be less than 52 mA.

Further, in the case that the control portion 41 changes only the state of the first switching circuit 15*a* into an on-state to thereby drive and causes only the first organic EL display element 11*a* to emit light, the proper current level of the total current Ix is a sum of 10 mA and 1 mA, that is, 11 mA (10 mA+1 mA=11 mA). In this case, the control portion 41 sets the reference value at 22 mA (=11×2), which is a current level that is twice the proper current level 11 mA.

When the total current Ix flowing through the second current-voltage converting circuit 39 increases to a value that is equal to or more than 22 mA, the control portion 41 becomes aware of an abnormal condition, and then reduces a control signal outputted to the voltage control circuit 32 so that the total current Ix is suppressed in such a manner as to be less than 22 mA.

Thus, heat generation in the drive circuit is prevented. Consequently, the destruction of each portion due to the heat generation and overcurrent is prevented.

Incidentally, in this embodiment, the control portion 41 outputs a control signal according to the driving current Iref of the reference organic EL display element 11*z*, which is detected by the first current-voltage converting circuit 38, and to the total current Ix detected by the second current-voltage converting circuit 39. Further, the control portion 41 continuously performs the adjustment of the output control signal in response to variation in the driving current Iref detected by the first current-voltage converting circuit 38. However, the control portion 41 performs the adjustment of the output control signal according to the total current Ix only in the case that the total current Ix is equal to or more than the certain threshold value. Furthermore, not only the control signal outputted from the control portion 41 but a signal representing variation in the stabilization voltage Vout are inputted to the operation amplifier 43 of the voltage control circuit 32 through the voltage dividing resistors 45 and 47. Thus, the control portion 41 provides feedback on the variation in the stabilization voltage Vout. That is, in this embodiment, the stabilization voltage Vout is adjusted by producing a logical sum of changes in three factors, namely, variation in the driving current of each of the organic EL display elements 11*a* and 11*n*, for which the driving current Iref of the reference organic EL display element 11*z* is substituted, and increase in the total current Ix, whose increased value becomes equal to or more than the threshold value, and variation in the stabilization voltage Vout. Consequently, in the case that the driving current Iref of the reference organic EL display element 11*z*, or the stabilization voltage Vout varies, unless leakage current is generated in one of the organic EL display elements 11*a* to 11*n*, the stabilization voltage Vout converges so that the driving current Iref of the reference organic EL display element 11*z* becomes constant. Furthermore, in the case that leakage current is generated in one of the organic EL display elements 11*a* to 11*n*, and that the value of the total current Ix becomes equal to or more than the threshold value, an operation of suppressing the stabilization voltage Vout by most preferentially using the increase in the total current Ix is performed.

Incidentally, in each of the aforementioned embodiments, a plurality of organic EL display elements 11*a* to 11*n* are parallel-connected to one another. Moreover, the stabilization voltage Vout is applied thereto as a common power source voltage. However, the drive device may be adapted to so that a single organic EL display element (for example, the first organic EL display element 11*a*) is installed therein, and that the stabilization voltage Vout is controlled by referring to the driving current Iref flowing through the reference organic EL display element 11*z*, which is provided separately from the first organic EL display element 11*a*, instead of the driving current Ia flowing through the display element.

A current sensing resistor (or current detecting element) Ras for detecting the collector currents Ix of these transistors Q11 ad Q6 and the current levels of the currents Ia to In is connected to the transistor Q11 of the stabilization voltage supply circuit 33 of the first embodiment and to the transistor Q6 of each of the switching circuits 15*a* to 15*n* of the second embodiment. In addition, the transistors Qa and Qas for reducing the base-emitter bias of these transistor Q11 or Q6 are connected thereto. However, the current sensing resistor Ras and the transistors Qa and Qas may be connected to both the transistor Q11 of the stabilization voltage supply circuit 33 and the transistor Q6 of each of the switching circuits 15*a* to 15*n*.

According to the first aspect of the present invention, the display element drive device is adapted so that at least one of the stabilization voltage supply circuit and the switching circuit has a transistor for supplying a driving current to the EL display element. The transistor is connected to a current detecting element for detecting a collector current of the transistor. Further, when the driving current rises to a certain abnormal level owing to leakage current of the EL display element, the bias suppressing element is turned on, so that the bias-emitter bias of the transistor is reduced. Thus, each portion of the device can be prevented from excessively generating heat, and from being destroyed by the generated heat and overcurrent.

According to the second aspect of the present invention, the stabilization voltage supply circuit is provided with a stabilization voltage supply element and with a current detecting element for detecting a current outputted from the stabilization voltage supply element. The control portion is adapted to have a function of detecting the driving state of the reference EL display element and changing the control signal for controlling the stabilization voltage according to the driving state, and a function of judging that leakage current of the EL display element abnormally increases, and changing the control signal to thereby limit the output level of the stabilization voltage outputted from the stabilization voltage supply element when the current detected by the current detecting element rises to an abnormally high level in comparison with a level of a driving current needed for driving the EL display element to emit light in the case that the on-switching of the switching circuit is performed in response to the switching signal. Thus, the stabilization voltage is controlled so that the driving state of the EL display element is constant. Moreover, the device has an advantageous effect in that when excessive current flows through the entire device owing to leakage current generated by the deterioration of the EL display element, each portion of the device can be prevented from excessively generating heat, and from being destroyed by the generated heat and overcurrent.

What is claimed is:

1. A display element drive device for driving a single electro luminescent (EL) display element or a plurality of EL display elements parallel-connected to one another, comprising:

a single stabilization voltage supply circuit for applying a stabilization voltage to said EL display element;

a reference EL display element parallel-connected to said EL display element;

driving state detecting means for detecting a driving state and for changing an output signal according to the driving state;

a voltage control circuit for controlling a constant voltage by supplying a stabilization voltage adjustment signal to said stabilization voltage supply circuit according to the output signal of said driving state detecting means so that the driving state of said reference EL display element is constant; and a switching circuit for switching between application and disapplication of the stabilization voltage to said EL display element, wherein at least one of said stabilization voltage supply circuit and said switching circuit has a transistor for supplying a driving current to said EL display element, and wherein said transistor is connected to a current detecting element for detecting a collector current of said transistor, and to a bias suppressing element for reducing a base-emitter bias of said transistor by on-switching when the current detected by said current detecting element rises to a certain abnormal level owing to leakage current of said EL display element.

2. A display element drive device for driving a single electro luminescent (EL) display element or a plurality of EL display elements parallel-connected to one another, comprising:

a single stabilization voltage supply circuit for applying a stabilization voltage to said EL display element;

a reference EL display element parallel-connected to said EL display element;

a control portion for detecting a driving state and for changing a control signal, which is used to control the stabilization voltage, according to the driving state;

a voltage control circuit for controlling a constant voltage by supplying a stabilization voltage adjustment signal to said stabilization voltage supply circuit according to the control signal outputted from said control portion so that the driving state of said reference EL display element is constant; and a switching circuit for switching between application and disapplication of the stabilization voltage to said EL display element, wherein said switching circuit is adapted to perform on-off switching according to a switching signal sent from said control portion, wherein said stabilization voltage supply circuit has a stabilization voltage supply element for adjusting an output level of the stabilization voltage according to the stabilization voltage adjustment signal supplied from said voltage control circuit, and further has a current detecting element for detecting a current outputted from said stabilization voltage supply element, wherein said control portion has a function of outputting to said switching circuit a switching signal for applying the stabilization voltage to said EL display element by on-switching of said switching circuit, wherein said control portion further has a function of judging that leakage current of said EL display element abnormally increases, and changing the control signal to thereby limit the output level of the stabilization voltage outputted from said stabilization voltage supply element when the current detected by said current detecting element rises to an abnormally high level in comparison with a level of a driving current needed for driving said EL display element to emit light in a case that the on-switching of said switching circuit is performed in response to the switching signal.

* * * * *